US006677735B2

(12) United States Patent
Xi

(10) Patent No.: US 6,677,735 B2
(45) Date of Patent: Jan. 13, 2004

(54) LOW DROP-OUT VOLTAGE REGULATOR HAVING SPLIT POWER DEVICE

(75) Inventor: Xiaoyu Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/024,397

(22) Filed: Dec. 18, 2001

(65) Prior Publication Data

US 2003/0111985 A1 Jun. 19, 2003

(51) Int. Cl.[7] ..... G05F 1/40
(52) U.S. Cl. ..... 323/273; 323/280
(58) Field of Search ..... 323/273, 272, 323/266, 313, 312, 303, 281, 269, 274, 280

(56) References Cited

U.S. PATENT DOCUMENTS 4,779,037 A * 10/1988 LoCascio ..... 323/275
6,469,480 B2 * 10/2002 Kanakubo ..... 323/269

* cited by examiner

*Primary Examiner*—Rajnikant B. Patel
(74) *Attorney, Agent, or Firm*—William B. Kempler; W. James Brady, III; Frederick J. Telecky, Jr.

(57) ABSTRACT

The present invention provides a low drop-out voltage regulator (200) that reduces gate capacitance and simplifies the compensation needed to maintain stability, without requiring additional and/or larger Miller capacitors (108), by splitting the output (220, 221) of the driver (112A) for different operational modes, selectively driving a small power device (206), a large power device (214) or both based on the mode.

21 Claims, 3 Drawing Sheets

LOW DROP-OUT VOLTAGE REGULATOR HAVING SPLIT POWER DEVICE

FIELD OF THE INVENTION

The invention relates generally to voltage regulators and, more particularly, to a low drop-out (LDO) voltage regulator with a split power device.

BACKGROUND OF THE INVENTION

A low drop-out (LDO) regulator is typically used in electronic devices such as cellular phones, laptop computers and other battery-powered electronic devices having a number of requirements relating to voltage regulation. An LDO is a type of linear regulator. A linear regulator uses a transistor or FET, operating in its linear region, to subtract excess voltage from the applied input voltage, producing a regulated output voltage. Dropout voltage is the minimum input to output voltage differential required for the regulator to sustain an output voltage within 100 mV of its nominal value.

LDO regulators for positive output voltages often use a PNP for the power transistor (also called a pass device). This transistor is allowed to saturate, so the regulator can have a very low drop-out voltage, typically around 200 mV compared with around 2 V for traditional linear regulators using an NPN composite power transistor. A negative-output LDO uses an NPN for its pass device, operating in a manner similar to that of the positive-output LDO's PNP device. Newer developments using a CMOS power transistor can provide the lowest drop-out voltage. With CMOS the only voltage drop across the regulator is the ON resistance of the power device times the load current. With light loads this can become just a few tens of millivolts.

An LDO with minimum quiescent current is desirable for battery powered applications. To minimize the quiescent current at light loads, while maintaining good transient performance at heavy loads, it is standard practice to have the LDO work in two modes: "sleep" and "on." Usually, in "sleep" mode, the maximum load current is limited to a few milliamps and quiescent current is at a minimum (approximately 10–20 $\mu$A). While in "on" mode, the load current can be as much as a few hundred milliamps and the quiescent current is higher (50–100 $\mu$A). A single power device for both operation modes, while satisfying heavy load operation, puts significant challenges on compensation in sleep mode. For example, in an internally compensated PMOS LDO in sleep mode, when the quiescent current is cut down and the parasitic pole at the PMOS gate moves to lower frequencies, a larger Miller capacitor is needed to reduce the bandwidth in order to maintain stability. This requires additional area.

It is therefore desirable to reduce the gate capacitance and simplify the compensation needed to maintain stability, without requiring additional and/or larger Miller capacitors. The present invention provides this by splitting the output of the driver for different operational modes, selectively driving a small power device, a large power device or both based on the mode.

BRIEF DESCRIPTION OF THE DRAWINGS

The above and further advantages of the invention may be better understood by referring to the following description in conjunction with the accompanying drawings in which corresponding numerals in the different figures refer to the corresponding parts, in which.

DETAILED DESCRIPTION

While the making and using of various embodiments of the present invention are discussed herein in terms of current and voltage control through the use of particular types of transistors, it should be appreciated that the present invention provides many inventive concepts that can be embodied in a wide variety of contexts. The specific embodiments discussed herein are merely illustrative of specific ways to make and use the invention, and are not meant to limit the scope of the invention.

The present invention provides a low drop-out (LDO) voltage regulator that reduces gate capacitance and simplifies the compensation needed to maintain stability, without to requiring additional and/or larger Miller capacitors, by splitting the output of the driver for different operational modes, selectively driving a small power device, a large power device or both based on the mode.

Figure 1:
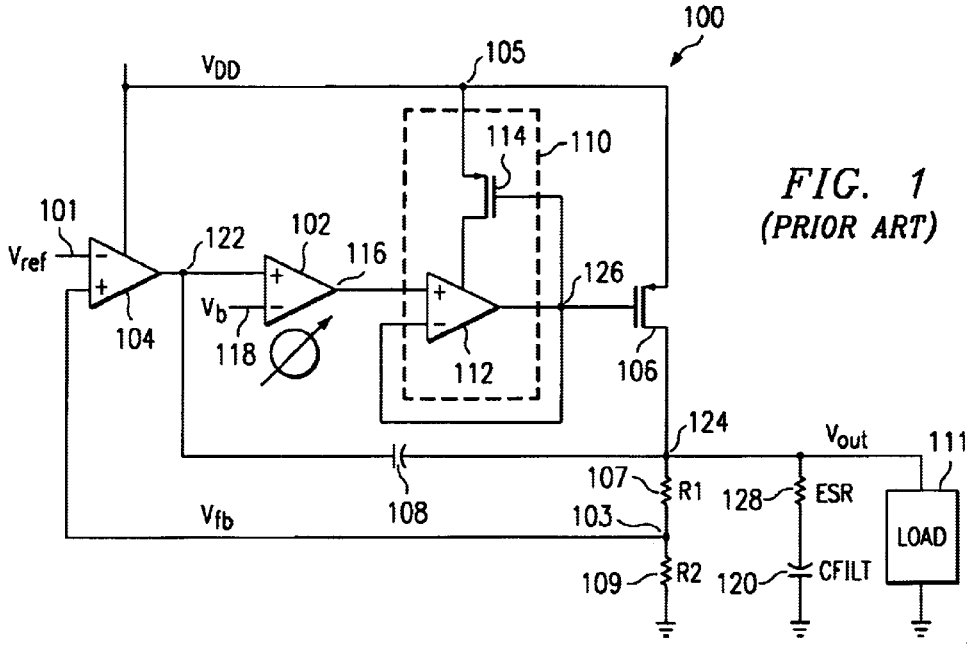
FIG. 1 (PRIOR ART)
FIG. 1 diagrammatically illustrates a PMOS LDO in accordance with the prior art.

FIG. 1 diagrammatically illustrates a PMOS LDO 100 in accordance with the prior art. This is disclosed, for example, in U.S. Pat. No. 6,246,221, incorporated herein by reference. Reference signal $V_{ref}$ 101 is supplied to the inverting input of error amplifier 104. Error amplifier 104 receives operational power from $V_{DD}$ at node 105 and also receives, at its non-inverting input, voltage $V_{fb}$ produced at node 103 between series-connected resistors 107 (R1) and 109 (R2). Error amplifier 104 has an output coupled at node 122 to the non-inverting input of non-inverting gain stage 102 and also coupled to Miller capacitor 108. The inverting input of non-inverting gain stage 102 is tied to dc voltage $V_b$ at 118, referenced to ground. Non-inverting gain stage 102 is a differential, single-stage amplifier that supplies a gate drive voltage to PMOS transistor 106 through buffer 110.

Buffer 110 includes a unity gain feedback single-stage amplifier 112 and PMOS transistor 114. Non-inverting gain stage 102 has an output coupled to the non-inverting input of amplifier 112 at node 116. The inverting input of amplifier 112 is tied to the output of amplifier 112 at node 126. Node 126 is also coupled to the gates of both PMOS transistors 114 and 106. The sources of PMOS transistors 114 and 106 are tied to $V_{DD}$ at node 105. The drain of PMOS transistor 114 is coupled to amplifier 112. Miller capacitor 108 is tied across multiple stages, i.e. variable gain stage 102, buffer 110 and to node 124. Series connected resistors 107 and 109 couple the drain of PMOS transistor 106 at node 124 to the ground supply voltage source. ESR 128, at node 124, is the electrical (equivalent) series resistance of filter capacitor CFILT 120, which runs to ground. Voltage output, $V_{out}$, is taken at node 124 to drive LOAD 111.

The present invention splits the power device, be it NMOS or PMOS, for different operational modes. For example, in "sleep" mode, since the max load is much smaller, only a small portion of the power device (e.g., a small power device) is used for output. While for "on" mode, the entire power device (e.g., both small and large power devices) is used. By using only the small device in "sleep" mode, it becomes relatively easy to push the parasitic pole at its gate outside the LDO bandwidth, thereby maintaining the stability of the LDO. Also, in order to minimize the transition from "sleep" mode to "on" mode, it is desirable to share as many stages as possible between the two modes. In order to accomplish this, the driver stage of the present invention is designed with an output for each mode. In the case of two (2) modes, such as "sleep" and "on," there will be two (2) outputs: one to a small power device and one to a large power device. In "sleep" mode, only the small power device is used and the large power device is disabled. In "on" mode, both devices can be used. In this way, all the stages preceding the driver are shared for both modes. The changes only occur at the driver output to the large power device, thereby minimizing transition time.

Figure 2:
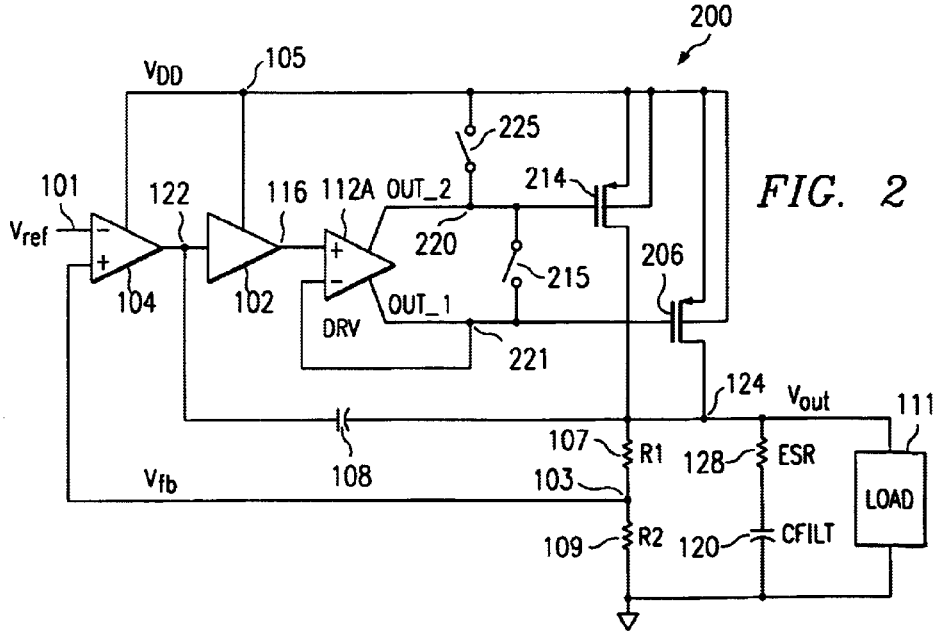
FIG. 2 diagrammatically illustrates a PMOS LDO in accordance with an embodiment of the present invention.

With reference now to FIG. 2, a PMOS LDO 200 in accordance with an exemplary embodiment of the present invention is diagrammatically illustrated. PMOS LDO 200 is similar to the LDO described in U.S. Pat. No. 6,246,221, but incorporates two (2) driver stage outputs as described above.

In FIG. 2, DRV 112A is a unity gain feedback amplifier with two (2) outputs: OUT_1 at node 221 and OUT_2 at node 220. The inverting input of DRV 112A is tied to node 221. Also at node 221, DRV 112A is coupled to switch 215 and to the gate of small PMOS transistor 206. Switch 215 is further coupled to the gate of large PMOS transistor 214. When closed, switch 225 couples DRV 112A at node 220 to $V_{DD}$ at node 105. DRV 112A is also coupled at node 220 to the gate of large PMOS transistor 214. The sources of large PMOS transistor 214 and small PMOS transistor 206 are tied to $V_{DD}$ at node 105. The drains of large PMOS transistor 214 and small PMOS transistor 206 are tied to node 124. The exemplary embodiment of FIG. 2 is otherwise structurally and operationally the same as in the example of FIG. 1.

Figure 3A:
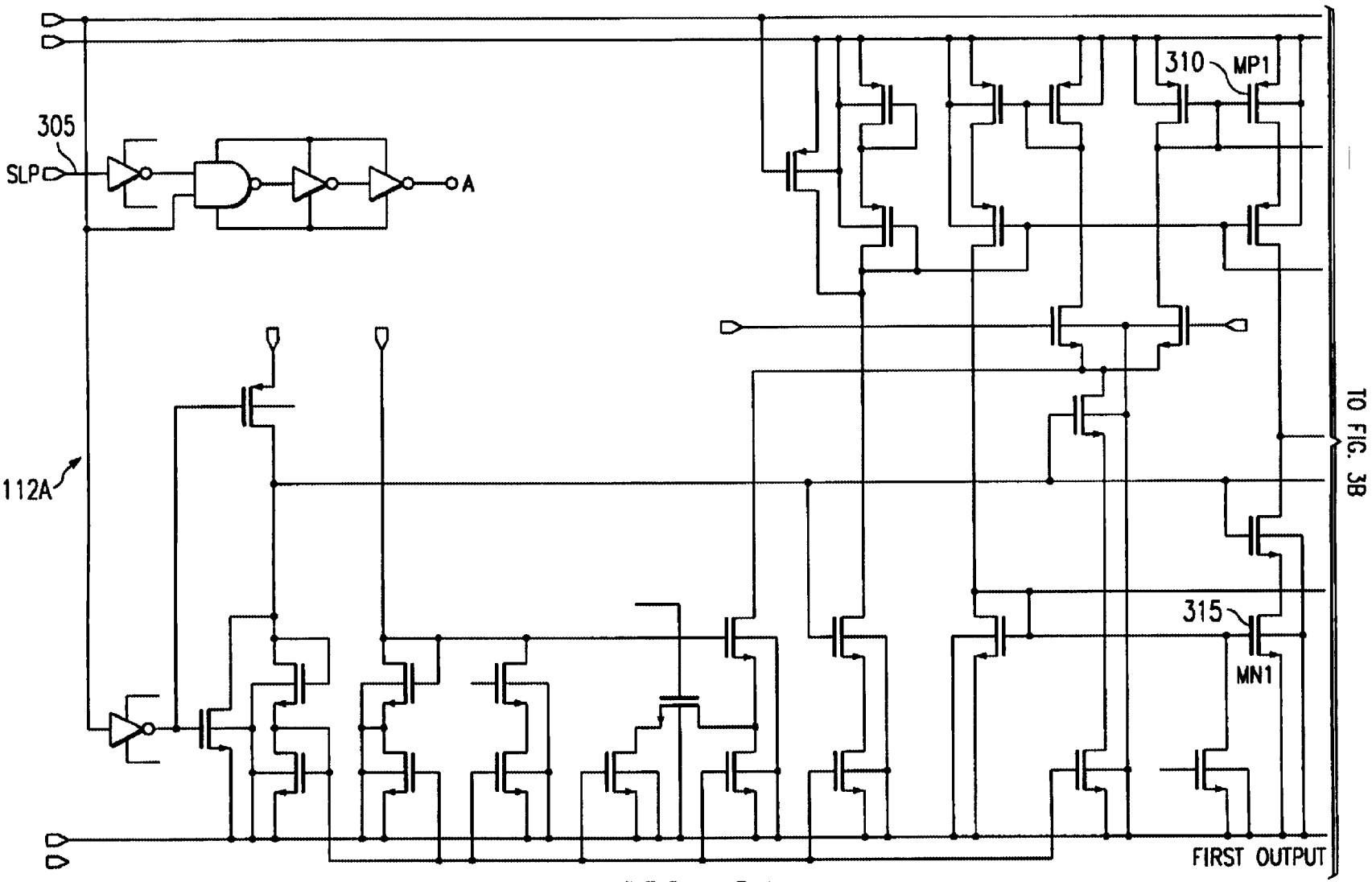
FIG. 3 diagrammatically illustrates a schematic of a driver in accordance with an embodiment of the present invention.
Figure 3B:
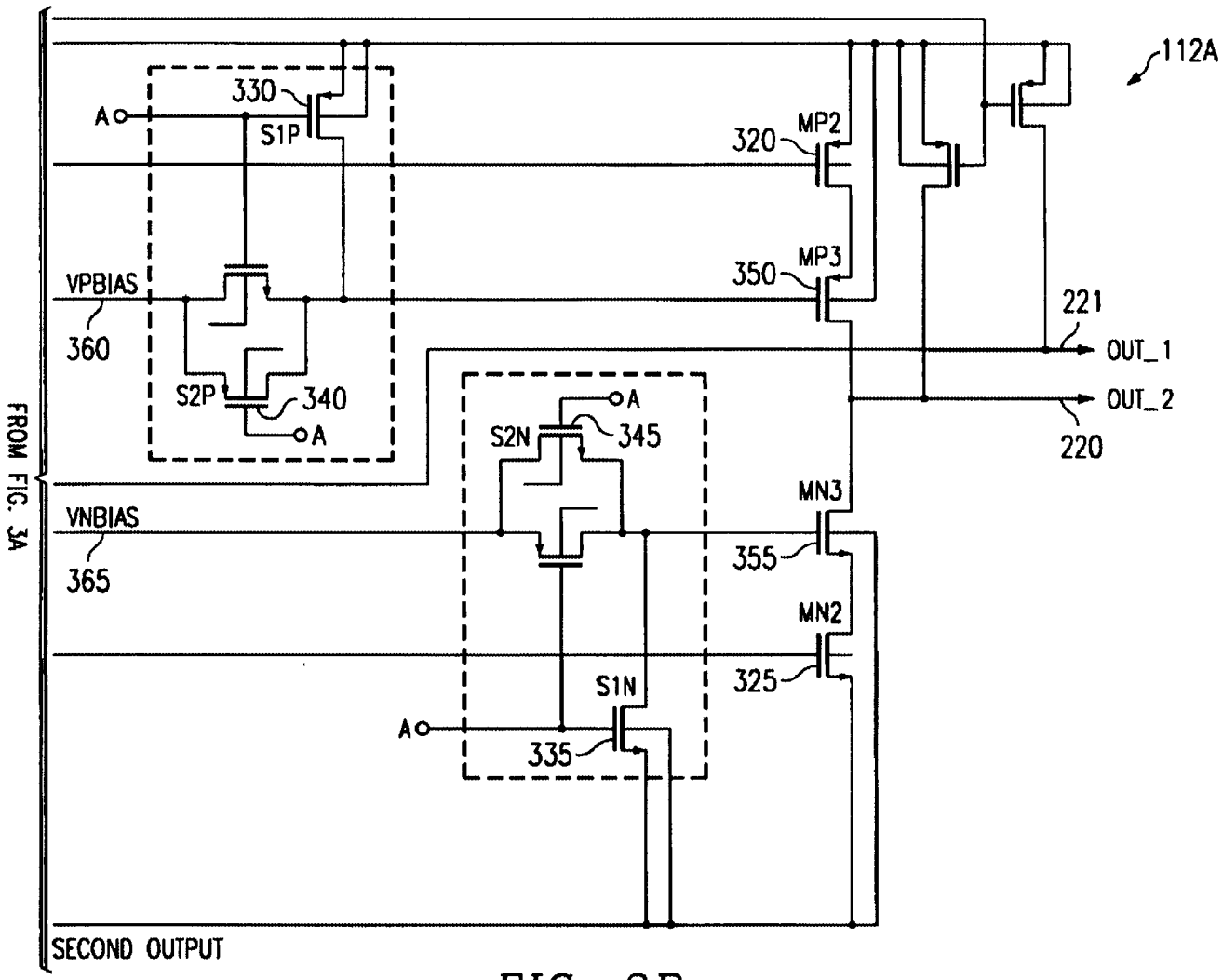

Separate drivers 112A can be used for each power device. Alternatively, to minimize redundant circuitry, a two-output driver, such as that shown in FIG. 3, can be used. FIG. 3 diagrammatically illustrates a schematic of an exemplary two-output driver DRV 112A in accordance with an embodiment of the present invention. Without the second output, DRV 112A would simply be a conventional single stage operational transconductance amplifier (OTA), with MP1 310 and MN1 315 constituting the output stage. The second output is a duplicate of the first output stage, but with a larger size. MP2 320 and MN2 325 constitute the second output. The first output drives small PMOS transistor 206 and the second output drives large PMOS transistor 214. The ratio between the two outputs can be optimized according to the split power devices. For the exemplary embodiment disclosed herein, a control bit can be used to set the mode of LDO 200. Alternatively, it is also possible to detect the load current level and have LDO 200 automatically switch modes. In exemplary DRV 112A, signal input (SLP) 305 sets the mode of LDO 200. For example, SLP 305="1" can set LDO 200 to "sleep" mode and SLP 305="0" can set LDO 200 to "on" mode. When in "sleep" mode, switches S1P 330 and S1N 335 are closed, while S2P 340 and S2N 345 are open. In this configuration, S2P 340 and S2N 345 are complementary transmission gates that use both PMOS and NMOS. Therefore, cascade transistors MP3 350 and MN3 355 are turned off. OUT_2 220 is also pulled up by switch 225. Thus, only OUT_1 221 is active and drives only small PMOS transistor 206. When in "on" mode, switches S1P 330 and S1N 335 are open, while S2P 340 and S2N 345 are closed. Therefore, MP3 350 and MN3 355, now biased by VPBIAS 360 and VNBIAS 365, are turned on and OUT_2 220 is active. OUT_2 220 is shorted to OUT_1 221 by switch 215. In both modes, OUT_1 221 is tied back to the inverting input of DRV 112A to complete the unity gain buffer.

While in "sleep" mode, an exemplary maximum load at 111 would be 1 mA with an exemplary quiescent current of 10 $\mu$A. Therefore, only small PMOS transistor 206 would be used. Operationally, when LDO 200 is in "sleep" mode, switch 225 is closed and switch 215 is open. This ties OUT_2 at node 220 to supply, thereby disabling large PMOS transistor 214. For "on" mode, an exemplary maximum load at 111 would be 300 mA with an exemplary current of 80 $\mu$A. For "on" mode, both large PMOS transistor 214 and small PMOS transistor 206 would be used. When LDO 200 is in "on" mode, switch 225 is open and switch 215 is closed. Therefore, OUT_2 at node 220 is connected to the inverting input of DRV 112A, completing the unity gain buffer. An exemplary ratio of large PMOS transistor 214 to small PMOS transistor 206 would be approximately 10:1.

Although exemplary embodiments of the present invention have been described in detail, it will be understood by those skilled in the art that various modifications can be made therein without departing from the spirit and scope of the invention as set forth in the appended claims.

What is claimed is:

1. A low drop-out voltage regulator having an "on" mode and a "sleep" mode, comprising:

an input error amplifier stage;

a first amplifier stage having a first output, a second output, a first input coupled to an output of said input error amplifier stage;

a first power transistor having a gate coupled to said first output, said first power transistor being coupled to a node where voltage is to be regulated;

a second power transistor having a gate coupled to said second output, said second power transistor being coupled to said node;

a control circuit coupled to the gates of the first and second power transistors for activating the first transistor when the regulator is in "sleep" mode and for activating the second transistor when the regulator is in the "on" mode, bias current to the first amplifier stage being reduced from the bias current when the reaulator is in the "on" mode when the regulator is in the "sleep" mode, whereby the regulator is stabilized in both the "sleep" and "on" modes; and a compensating capacitor coupled between said node and said input error amplifier stage.

2. The low drop-out voltage regulator of claim 1 wherein the control circuit comprises a switch coupled between the second output of the first amplifier stage and a supply voltage.

3. The low drop-out voltage regulator of claim 1 further wherein the control circuit comprises a switch coupled between the first output of the first amplifier stage and the second output of the first amplifier stage.

4. The low drop-out voltage regulator of claim 3, wherein the control circuit further comprises switch coupled between the second output of the first amplifier stage and a supply voltage.

5. The low drop-out voltage regulator of claim 1 wherein the second power transistor is larger than the first power transistor.

6. The low drop-out voltage regulator of claim 5 wherein the second power transistor is approximately ten times as large as the first power transistor.

7. The low drop-out voltage regulator of claim 1 wherein the first power transistor is a PMOS transistor having a drain coupled to said node and a source coupled to a supply voltage.

8. The low drop-out voltage regulator of claim 7 wherein the second power transistor is a PMOS transistor having a drain coupled to said node and a source coupled to a supply voltage.

9. The low drop-out voltage regulator of claim 1 including a further gain amplifier stage connected between said error amplifier stage and first amplifier stage.

10. The low drop-out voltage regulator of claim 9 wherein further gain amplifier stage is a non-inverting variable gain amplifier stage.

11. A low drop-out voltage regulator comprising:

a supply voltage node;

an output voltage node;

a first power transistor having a source connected to the supply voltage node, a drain connected to the output voltage node and a gate;

a second power transistor having a source connected to the supply voltage node, a drain connected to the output voltage node and a gate;

a unity gain amplifier having a first output connected to the gate of the first power transistor, a second output connected to the gate of the second power transistor, an inverting input connected to the first output of the unity gain amplifier, and a non-inverting input;

a control circuit coupled to the gates of the first and second power transistors for activating the first transistor when the regulator is in "sleep" mode and for activating the second transistor when the regulator is in the "on" mode, bias current to the unity gain amplifier stage being reduced from the bias current then the regulator is in the "on" mode when the regulator is in the "sleep" mode, whereby the regulator is stabilized in both the "sleep" and "on modes; and a variable gain amplifier having an output connected to the unity gain amplifier non-inverting input;

a differential amplifier having an output connected to an input of the variable gain amplifier;

a voltage divider network having a first node connected to the output voltage node, a second node connected to ground and a third node connected to an input of the differential amplifier, providing thereto a feedback voltage; and a compensation capacitor connected between said output voltage node and the differential amplifier output.

12. The low drop-out voltage regulator of claim 1 wherein the first amplifier stage is a unity gain amplifier stage having a second input coupled to said first output.

13. The low drop-out voltage regulator of claim 1 further comprising an external signal coupled to said control circuit to place said regulator in the "sleep" or "on" mode.

14. A method of operating a low-drop out voltage regulator in order to maintain stability in "sleep" and "on" modes, comprising:

providing a first transistor path coupled between an unregulated voltage source and a regulated node, providing a second transistor path coupled between the unregulated voltage source and the regulated node, the second transistor being larger than the first transistor;

driving the first and second transistors with an amplifier stage, the bias to the amplifier stage being at a first level when the first transistor is being driven and being at a second level when the second transistor is being driven, the first transistor being driven when the regulator is in the "sleep" mode and the second transistor being driven when the regulator is in the "on" mode.

15. The method of claim 14 further comprising controlling the mode of the regulator by an external signal which places the regulator in the "sleep" or "on" mode.

16. The method of claim 14 wherein the second transistor is inactivated in the "sleep" mode by closing a first switch coupled to a gate thereof.

17. The method of claim 16 wherein a second switch is opened in the "sleep" mode.

18. The method of claim 16 wherein the first switch couples the gate of the second transistor to its source.

19. The method of claim 17 wherein the first switch couples the gate of the second transistor to its source.

20. The method of claim 14 wherein the gate of the first and second transistors are coupled together by closing a second switch when the regulator is in the "on" mode.

21. In a low drop-out voltage regulator having "on" and "sleep" modes, the regulator having an input error amplifier stage and a first amplifier stage coupled to an output of the input error amplifier stage, a power stage comprising:

a first power transistor coupled between a voltage source and a regulated voltage output and having a gate coupled to a first output of the first amplifier for operating during the "sleep" mode;

a second power transistor coupled between the voltage source and the regulated voltage output and having a gate coupled to a second output of the first amplifier stage for operating during the "on" mode, whereby a parasitic pole at the gate of the first power transistor in the "sleep" mode will be outside the regulator bandwidth.

* * * * *